US006514340B1

(12) United States Patent
Momose et al.

(10) Patent No.: US 6,514,340 B1
(45) Date of Patent: Feb. 4, 2003

(54) LUBRICANT COAT FORMING APPARATUS

(75) Inventors: Kimio Momose, Wako (JP); Mamoru Yamamoto, Wako (JP); Seiichi Akimoto, Wako (JP); Ryosuke Fukuchi, Osaka (JP); Kenichirou Ikeda, Osaka (JP); Kazuhiro Matsushita, Osaka (JP)

(73) Assignee: Okaya & Co., Ltd., Nagoya (JP)

( * ) Notice: Subject to any disclaimer, the term of this patent is extended or adjusted under 35 U.S.C. 154(b) by 15 days.

(21) Appl. No.: 09/656,530

(22) Filed: Sep. 7, 2000

(30) Foreign Application Priority Data

Oct. 6, 1999 (JP) ..... 11-285430
Jul. 19, 2000 (JP) ..... 2000-219192

(51) Int. Cl.[7] ..... B05C 19/06

(52) U.S. Cl. ..... 118/58; 118/66; 118/69; 118/72; 118/407; 118/423

(58) Field of Search ..... 118/687, 643, 118/66, 69, 58, 72, 319, 322, 324, 407, 423; 427/314, 398.5

(56) References Cited

U.S. PATENT DOCUMENTS 4,963,400 A * 10/1990 Bibbee et al. ..... 427/374.1
5,025,750 A * 6/1991 Sessa et al. ..... 118/69
5,518,768 A * 5/1996 Wallace et al. ..... 427/284

* cited by examiner

*Primary Examiner*—Laura Edwards
(74) *Attorney, Agent, or Firm*—Perkins Coie LLP

(57) ABSTRACT

The present invention provides a lubricant coat forming apparatus for forming a dry coat of water dry type lubricant on the surface of each of cold plastic working materials. The apparatus includes a heating unit for heating the cold plastic working materials to a predetermined temperature, a lubricant applicator for applying the lubricant on the surfaces of the cold plastic working materials heated at the heating unit, and a drying unit for drying the lubricant applied on the surfaces of the cold plastic working materials by applying cooling air stream to them. The cooling air stream has a temperature lower than that of the cold plastic working materials heated by the heating unit.

2 Claims, 9 Drawing Sheets

LUBRICANT COAT FORMING APPARATUS

BACKGROUND OF THE INVENTION

1. Background of the Invention

The present invention relates to an apparatus for forming a dry coat of the lubricant for cold forging on cold plastic working materials (e.g., rod, tubular, plate and other shaped members, sintered materials, etc., made of steel, titanium, titanium alloy, copper, copper alloy, aluminium, or aluminium alloy), which are cold forged by using a pressing machine.

2. Description of the Prior Art

Recently employed process applied to cold forging of the cold plastic working materials includes is forming thereon a dry coat of the lubricant for cold forging. Specifically, the process includes heating the cold plastic working materials to a predetermined temperature, applying water dry type lubricant on the heated materials, and applying heated air stream of a temperature higher than that of the cold plastic working materials, thereby drying the lubricant applied on the materials.

The above process, which includes drying the cold plastic working materials heated to a predetermined temperature by the application of the heated air stream having a temperature higher than that of the material, poses a problem that the cold plastic working materials are heated to an excessively high temperature. This excessively high temperature of the materials may shorten the life of a metal mold in the pressing machine when the materials for cold plastic working of such an excessively high temperature is fed to the pressing machine. To avoid this problem, a material cooling time is needed to lower the temperature of the cold plastic working materials prior to being fed to the pressing machine.

To heat the cold plastic working materials to a predetermined temperature in a conventional manner, a heating chamber is disposed in a conveying line of the cold plastic working materials, through which the cold plastic working materials successively pass, so that they are heated under a high temperature atmosphere within the heating chamber. This conventional heating arrangement inherently requires a lengthened heating chamber extending along the conveying path so as to heat the cold plastic working materials during the conveyance of the cold plastic materials at a usual transfer speed. However, when the heating chamber is to be installed in a limited space, it may not have a sufficient length, with the result that the transfer speed needs to be lowered to allow the cold plastic materials to stay within the heating chamber for a prolonged period of time.

In either way, a prolonged period of time is needed for forming lubricant dry coat, which is disadvantageous in the fact that such a lower coat-forming speed cannot match the operation speed of the pressing machine.

Therefore, it is an object of the present invention to provide a lubricant coat forming apparatus that is capable of forming a dry coat at a sufficient speed to match the operational speed of the pressing machine.

SUMMARY OF THE INVENTION

Extensive efforts have been devoted by the present inventors to achieve the above object. These efforts have led to the finding of the fact that the temperature of the air stream for drying the coat affects on the dry time. Upon such a fact, the present inventors have obtained the knowledge that cooling air stream would be suitable for shortening a coat drying time rather than using a hot air stream, and hence achieved the present invention.

Specifically, according to one aspect of the present invention, there is provided a lubricant coat forming apparatus for forming a dry coat of water dry type lubricant on the surface of each of cold plastic working materials. The apparatus includes a heating unit for heating the cold plastic working materials to a predetermined temperature, a lubricant applicator for applying the lubricant on the surfaces of the cold plastic working materials heated at the heating unit, and a drying unit for drying the lubricant applied on the surfaces of the cold plastic working materials by applying cooling air stream to the cold plastic working materials. The cooling air stream has a temperature lower than that of the cold plastic working materials heated by the heating unit.

By "heating the cold plastic working materials to a predetermined temperature", it is meant that the cold plastic working materials are heated to a temperature higher than the atmospheric temperature (e.g., not less than 60° C.). By "the air stream has a temperature lower than that of the cold plastic working materials heated by the heating unit", it is meant that the air stream has a temperature lower than that the temperature (predetermined temperature) of the cold plastic working materials themselves, which have been heated by the heating unit. For example, when the cold plastic working materials are heated to about 60° C. at the heating unit, it is preferable to set the temperature of the cooling air at lower than about 60° C., more particularly in the range between 25 to 45° C.

According to another aspect of the present invention, there is provided a lubricant coat forming apparatus for forming a dry coat of water dry type lubricant on the surface of each of cold plastic working materials. The apparatus includes a heating unit for heating the cold plastic working materials to a predetermined temperature, a lubricant applicator for applying the lubricant on the surfaces of the cold plastic working materials heated at the heating unit, a drying unit for drying the lubricant applied on the surfaces of the cold plastic working materials. The heating unit includes a plurality of storage chambers disposed at intervals for respectively storing the cold plastic working materials, a throw-in port through which the cold plastic materials are thrown into the plurality of storage chambers, and a discharging port through which the cold plastic working materials are discharged from the plurality of storage chambers. The plurality of storage chambers are adapted to travel along a circular path starting from the throw-in port and returning thereto via the discharging port. The heating unit further includes a heated air application means for applying heated air stream to the cold plastic working materials stored in the plurality of storage chambers, thereby heating the cold plastic working materials to a predetermined temperature.

With the above arrangement, the cold plastic working materials are successively thrown into the plurality of storage chambers through the throw-in port. The storage chambers with the cold plastic working materials therein travel along the circular path. During the travel, the heated air stream is directly applied to the cold plastic working materials to heat them to a predetermined temperature, and the cold plastic working materials are then successively discharged towards the lubricant applicator.

According to still another aspect of the present invention, there is provided a lubricant coat forming apparatus for forming a dry coat of water dry type lubricant on the surface of each of cold plastic working materials. The apparatus includes a heating unit for heating the cold plastic working materials to a predetermined temperature, a lubricant applicator for applying the lubricant on the surfaces of the cold plastic working materials heated at the heating unit, and a drying unit for drying the lubricant applied on the surfaces of the cold plastic working materials. The heating unit includes a plurality of storage chambers disposed at intervals for respectively storing the cold plastic working materials, a throw-in port through which the cold plastic materials are thrown into the plurality of storage chambers, and a discharging port through which the cold plastic working materials are discharged from the plurality of storage chambers. The plurality of storage chambers are adapted to travel along a circular path starting from the throw-in port and returning thereto via the discharging port. The heating unit further includes a means for immersing the cold plastic working materials stored in the plurality of storage chambers in a hot bath, thereby heating the cold plastic working materials to a predetermined temperature.

According to another aspect of the present invention, there is provided a lubricant coat forming apparatus for forming a dry coat of water dry type lubricant on the surface of each of cold plastic working materials. The apparatus includes a heating unit for heating the cold plastic working materials to a predetermined temperature, a lubricant applicator for applying the lubricant on the surfaces of the cold plastic working materials heated by said heating unit, and a drying unit for drying the lubricant applied on the surfaces of the cold plastic working materials. The heating unit includes a plurality of storage chambers disposed at intervals for respectively storing the cold plastic working materials therein, a throw-in port through which the cold plastic materials are respectively thrown into the plurality of storage chambers, and a discharging port through which the cold plastic working materials are discharged from said plurality of storage chambers. The plurality of storage chambers are adapted to travel along a circular path starting from the throw-in port and returning thereto via the discharging port. The heating unit further includes a means for immersing the cold plastic working materials stored in the plurality of storage chambers in hot water, thereby heating the cold plastic working materials to a predetermined temperature.

With the above arrangement, the cold plastic working materials are successively thrown into the plurality of storage chambers through the throw-in port. The storage chambers with the cold plastic working materials therein travel along the circular path. During the travel, the cold plastic working materials are immersed in the hot water to be heated to a predetermined temperature, and the heated cold plastic working materials are then successively discharged towards the lubricant applicator.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

With reference to the attached drawings, the description will be made for one embodiment of the lubricant coat forming apparatus with an arrangement that the water dry type lubricant for cold forging is applied on the surfaces of cold plastic working materials 1 to be cold forged, and the applied lubricant is subsequently dried to form a dry coat of the lubricant on the surface of each cold plastic working material 1.

The lubricant coat forming apparatus of the present invention can be applied to the cold plastic working materials of various shapes. However, for the illustrative purpose, this embodiment will be described by taking for example the case that rod shaped cold plastic working materials each having a stepped configuration with a head portion la having a larger diameter and a tail portion having a smaller diameter are processed.

Figure 1:
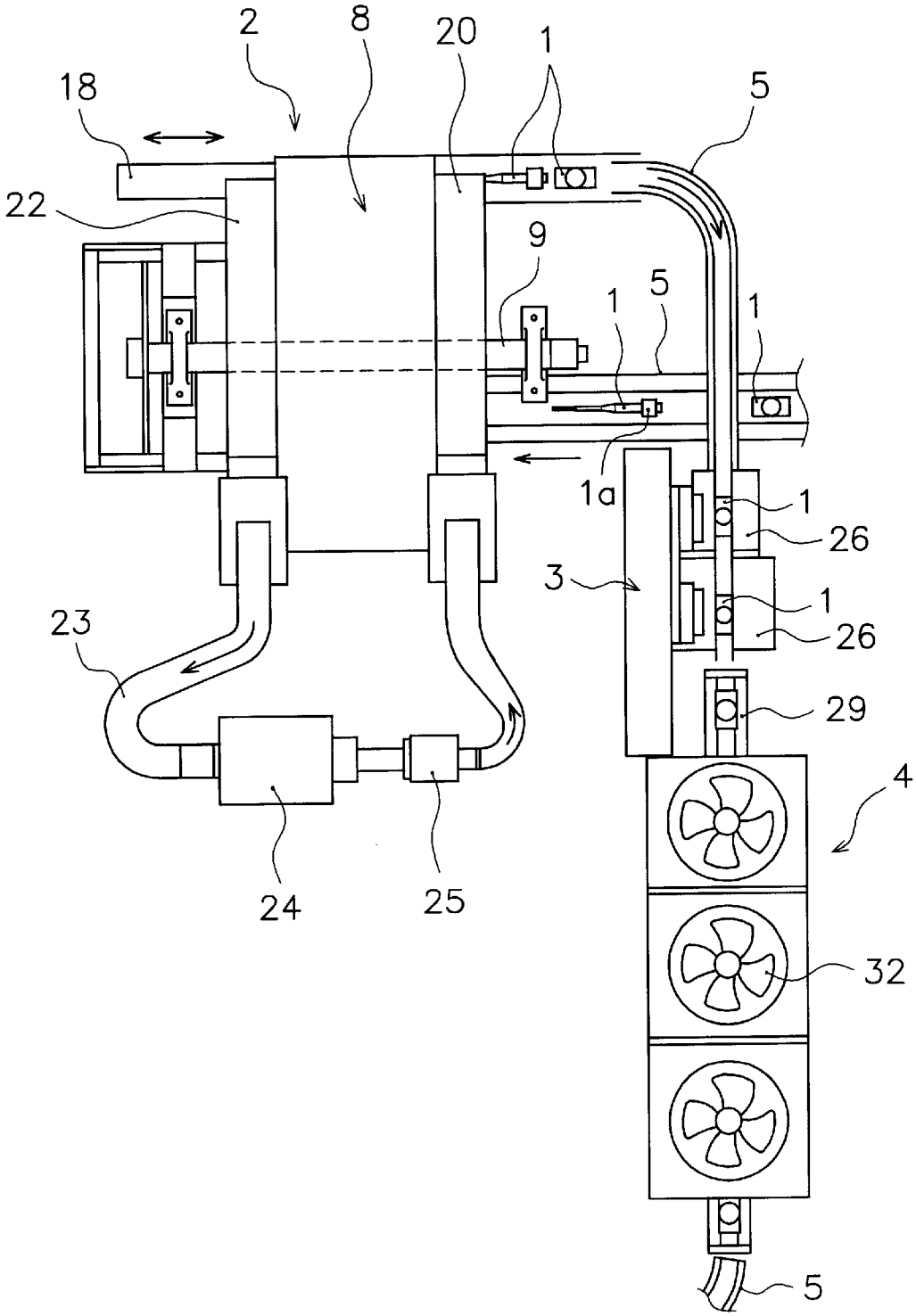
FIG. 1 is a schematic plan view of a lubricant coat forming apparatus according to one embodiment of the present invention.

FIG. 1 is a schematic plan view of the lubricant coat forming apparatus according to this embodiment, which is illustrated as being located in a conveying line adapted to feed the cold plastic working materials to a pressing machine therethrough. Aligned in sequence from the upstream to the downstream of the lubricant coat forming apparatus are a heating unit 2 as a heating means for heating the cold plastic working materials 1 to a predetermined temperature, an applicator 3 as a lubricant application means for applying lubricant to the surfaces of the cold plastic working materials 1 heated at the heating unit 2, and a drying unit 4 as a drying means for drying the lubricant applied on the surfaces of the cold plastic working materials at the applicator 3. The conveying line for conveying the cold plastic working materials 2 includes a conveyor belt 5, which hangs the cold plastic working materials 1 with their axes generally vertically orienting during the conveyance, and horizontally orienting just before the cold plastic working materials 1 are fed into the heating unit 2 and just after they are discharged therefrom, so that the head portions 1*a* having a larger diameter face oppositely with respect to the heating unit 2 or tail portions having a smaller diameter face the heating unit 2. The description will hereinbelow be made subsequently for the respective steps.

First Embodiment

Figure 2:
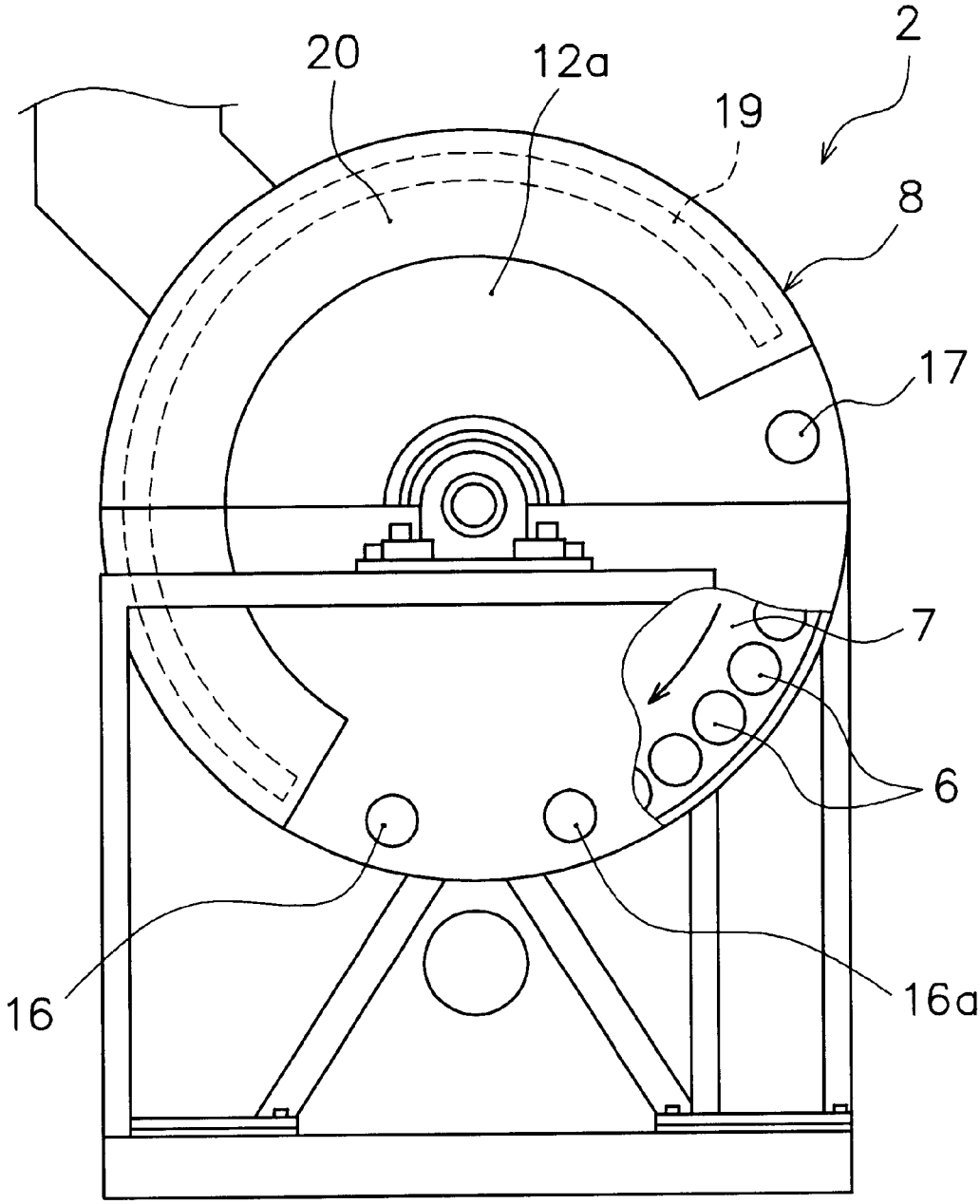
FIG. 2 is a front view partially broken away of a portion of a heating unit of the lubricant coat forming apparatus.
Figure 3:
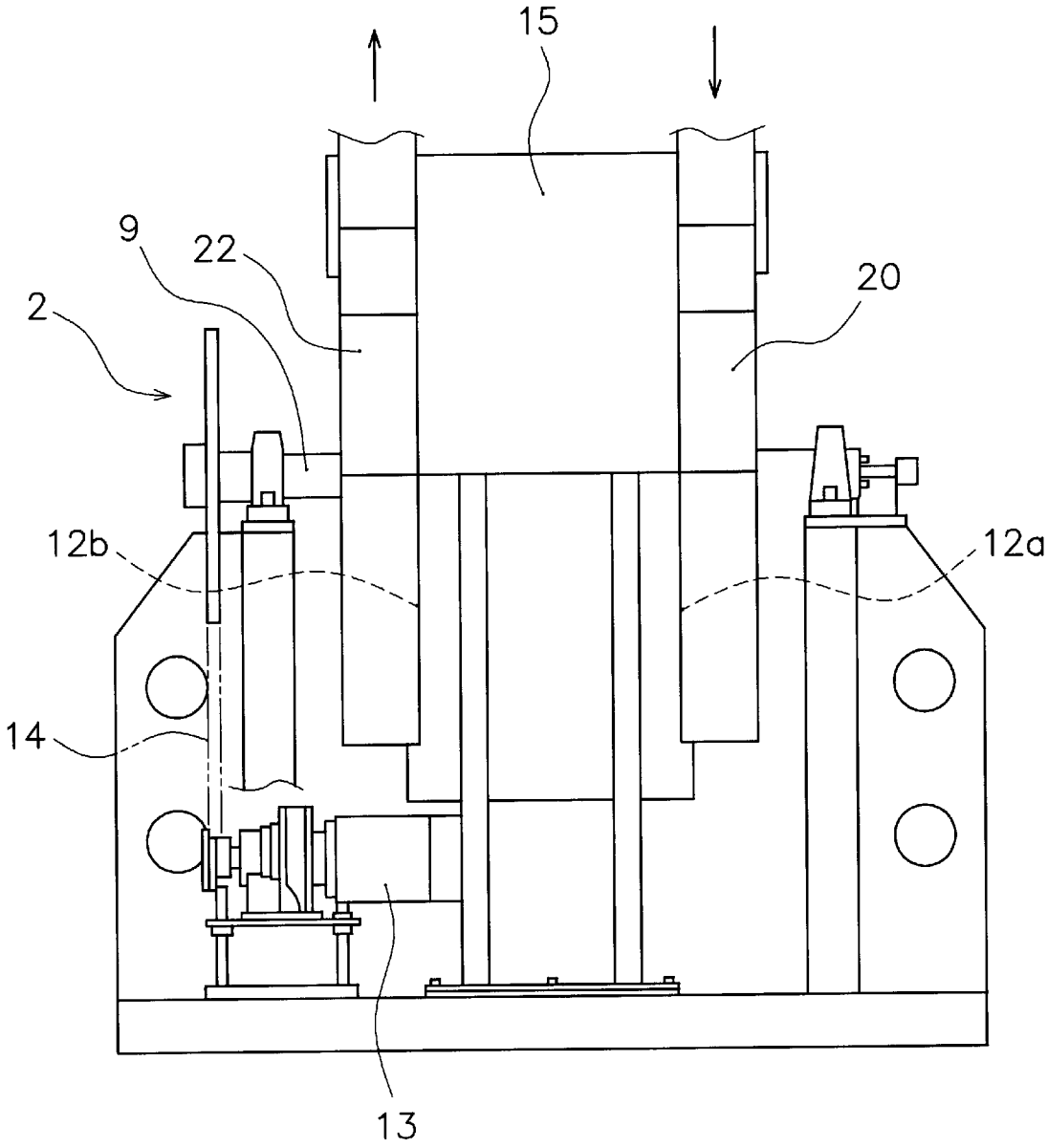
FIG. 3 is a side view of the heating unit.
Figure 4:
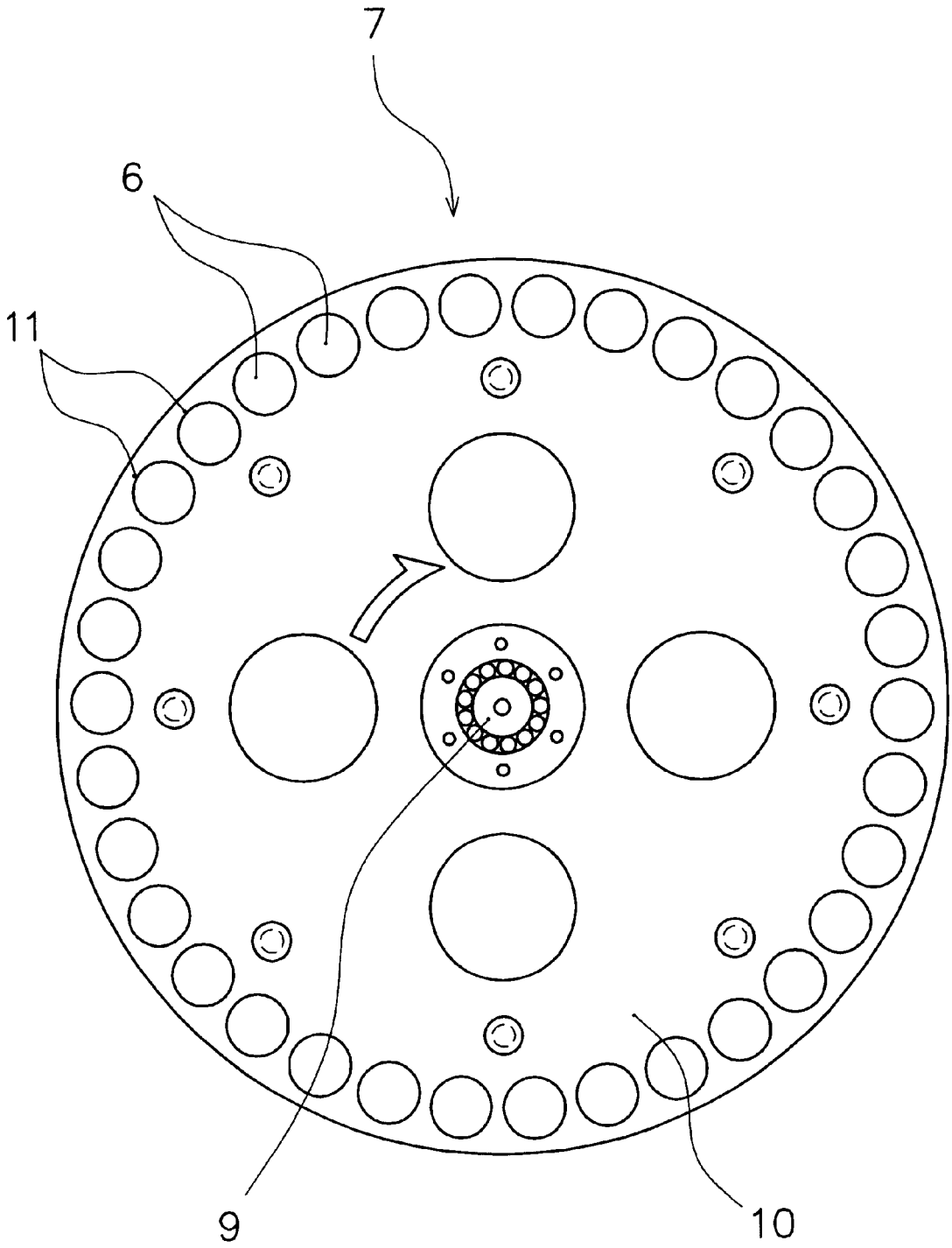
FIG. 4 is a front view of an essential portion of the heating unit.

As illustrated in FIG. 2, the heating unit 2 includes a rotating drum 7 having a cylindrical body with storage chambers 6 for respectively storing the cold plastic working materials 1 therein, a fixed cover member 8 covering the rotating drum 7 to constitute a substantially sealed heating chamber.

The storage chambers 6 of the rotating drum 7 each extend parallel to the axis of the rotating drum 7 and are open to the outside of the rotating drum 7 through both end surfaces of the rotating drum 7. The storage chambers 6 are disposed around the circumferential periphery of the rotating drum 7 at intervals. In this embodiment, 34 storage chambers are disposed at a constant pitch of substantially eleven degrees on the same circle.

The rotating drum 7 includes a substantially horizontally extending rotating shaft 9 adapted to be driven by a motor 13, two circular plates 10 respectively fixed to the front and rear sides of the rotating shaft 9, and a plurality of hollowed cylindrical members 11 extending between both circular plates 10. The circular plates 10 each define rounded holes around the circumferential periphery at intervals to securely receive the cylindrical members 11, thereby respectively forming the storage chambers 6 within the cylindrical members 11. The rotating shaft 9 extends through the cover member 8 to have both ends thereof supported by side walls 12 of the cover member 8, and one of said both ends projecting away from the cover member 8 and operatively connected to the motor 13 via a driving chain 14, thereby transmitting a driving force of the motor to the rotating shaft 9. The motor 13 is controlled to intermittently rotate with an intermittent pitch matching with the pitch of the storage chambers 6.

The cover member 8 has a shape adapted to the outer contour of the rotating drum 7, and includes a circumferential wall 15 covering the circumferential periphery of the rotating drum 7, and front and rear side walls 12*a* and 12*b* respectively covering both sides of the rotating drum 7 oppositely disposed with respect to the axis of the rotating drum 7. Defined in the front side wall 12*a* are a material throw-in port 16 (material throw-in member) through which the cold plastic working materials 1 fed by the conveyor belt 5 are thrown in and a material discharging port 17 (material discharging member) through which the cold plastic working materials 1 are discharged onto the conveyor belt 5. Both ports have a rounded hole configuration and are aligned along the circular path of the storage chambers 6. The angles between the throw-in port 16 and the discharging port 17 are integral multiples of the spacing pitch of the storage chambers 6. The rear side wall 12*b* defines therein a rounded hole (not shown) whose position corresponds to the discharging port 17, so that the storage chambers 6 each are aligned with the rounded hole and the discharging port 17 at each stop during the intermittent operation of the rotating drum 7. Disposed rearwards to the rear side wall 12 is a pusher 18 movable into and away from the storage chambers 6 through the rounded hole to push the cold plastic working materials 1 out of the storage chambers 6 through the discharging port 17 of the front side of the rotating drum 7, thereby feeding them onto the conveyor belt 5 located forwards to the rotating drum 7. When two lines of the conveyor belt 5 are arranged, an additional throw-in port 16*a* is preferably formed for a different line, as illustrated in FIG. 2.

The heating unit 2 is designed to heat the cold plastic working materials 1 to a temperature higher than surrounding temperature by applying heated air stream to them stored in the storage chambers 6. Specifically, the front side wall 12*a* of the cover member 8 defines therein a heated air sending port in the form of a slit 19 for introducing the heated air stream therethrough, as illustrated in broken lines in FIG. 2. The slit 19 extends in the circumferential direction of the front side wall 12*a* within a predetermined angular range between the throw-in port 16 and the discharging port 17, and is provided on the front side thereof with a heated air stream supplying duct 20 having a sealed inner space therein, which is positioned in such a manner as to cover the slit 19. On the other hand, the rear side wall 12*b* defines therein a heated air discharging port in the form of a slit 21 for discharging the heated air stream therethrough, whose position corresponds to the slit 19, and is provided on the rear side thereof with a heated air stream discharging duct 22 having a sealed inner space (see FIG. 5).

The slit 19 has a width narrower than the diameter of the storage chambers 6, so that highly pressurized air stream can pass through the storage chambers 6, which are moved with their axes orthogonal to the lengthwise direction of the slit 19. The slit 21 has a width wider than that of the slit 19 and substantially equal to the diameter of the storage chambers 6.

As illustrated in FIG. 1, the ducts 20 and 22 are communicated with each other via an air circulating passage 23, which is provided with a fan 24 as an air sending means for sending the air to the duct 20 for the air circulation between the ducts, and a heater 25 as an air heating means which heats the air to maintain the temperature of the heated air stream fed through the slit 19 at a predetermined level.

With the above arrangement, the heated air stream sent by the fan 24 is reheated to a predetermined temperature by the heater 25 controlled by a control means, then sent to the duct 20 through the air circulating passage 23, and then introduced into the inside of the cover member 8 through the slit 19. Since there exists little clearance between the corresponding side wall 12 and circular plate 10, the heated air stream sent through the slit 19 is mostly introduced into those of the storage chambers 6 travelling along the slit 19 to be in communication with the air circulating passage 23 via the slit 19, passes through the respective storage chambers 6, and then is drawn into the duct 22 through the opposite slit 21. During the heated air stream passes through the storage chambers 6, the temperature drop occurs in that stream due to the heat transmission to the cold plastic working materials 1. The heater 25 reheats the air stream to constantly send the heated air stream to the storage chambers 6 at a predetermined temperature. The cold plastic working materials 1 are heated to, for example, about 60° C. by the heating unit 2.

Now, the description will be made for the applicator 3 that applies lubricant to the surfaces of the cold plastic working materials 1 heated to a predetermined temperature at the heating unit 2.

As illustrated in FIG. 1, the applicator 3 is disposed between the heating unit 2 and the drying unit 4, and includes a lubricant reservoir 26 for storage liquidized lubricant and a holding member (not shown). The holding member is constructed in such a manner as to hold the cold plastic working materials 1 conveyed by the conveyor belt 5 with their axes vertically oriented, and reciprocate in the vertical direction, allowing the cold plastic working materials 1 to be successively immersed in the lubricant. The lubricant in the reservoir 26 has a temperature equal to the temperature of the cold plastic working materials 1 to retain the heated temperature of the cold plastic working materials 1. For example, the lubricant is set at about 60° C. Means for applying the lubricant may be take various forms, such as a nozzle for discharging pressurized lubricant therethrough.

Figure 6:
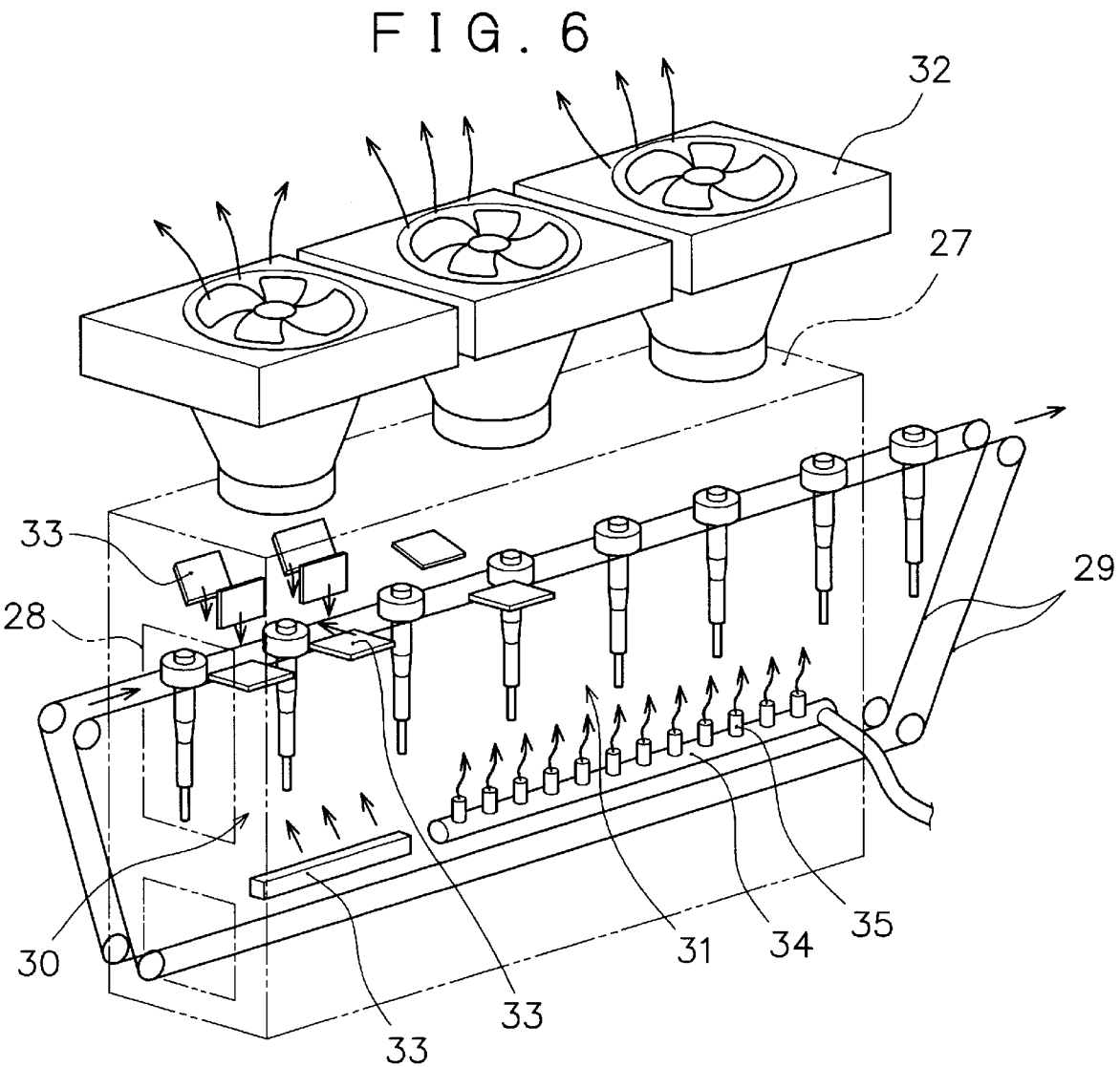
FIG. 6 is a schematic perspective view of a drying unit of the lubricant coat forming apparatus.

The description will also be made for the drying unit 4 for drying the lubricant with reference to FIG. 6. The drying unit 4 has an elongated box shape with a longitudinal axis extending along the direction of conveyance, and includes a drying chamber 27 with outlet and inlet ports 28 defined therein open to the upstream and downstream sides of the conveying path, and an endless conveyor chain 29 extending in a straight line parallel to the conveying path for receiving the cold plastic working materials 1 from the applicator 3 and conveying the same through the drying chamber 27 in a straight line. In this embodiment, two endless chains 29 are arranged parallel to one another with the conveying path therebetween, allowing the cold plastic working materials 1 to hang from the parallel endless chains 29 during the conveyance.

The drying chamber 27 includes a highly pressurized air discharging member 30 disposed at the upstream side for blowing away the stagnant lubricant on the cold plastic working materials 1 conveyed by the parallel endless chains 29 with highly pressurized air, and an air blower 31 disposed at the downstream side of the highly pressurized air discharging member 30 for applying air stream towards the cold plastic working materials 1 from below, thereby drying the lubricant. Provided above the drying chamber 27 are exhaust fans 32 for exhausting the air to the above.

The highly pressurized air discharging member 30 includes nozzles 33 respectively located upper, lower and lateral sides with respect to the parallel endless chains 29, so that the pressurized air can be applied to substantially the entire surface of the cold plastic working materials 1 through these nozzles. The air blower 31 is formed by an air blowing tube 34 disposed along the conveying path and under the parallel endless chain 29, and has nozzles 35 in the upper side of the tube 34 at intervals along the lengthwise direction. The air blowing tube 34 is communicated with an air sending means (not shown) to feed a dry outside air of, for example, about 30° C., thereby applying to the cold plastic working materials 1 the air stream cooler than the cold plastic working materials 1.

In the lubricant forming apparatus according to this embodiment, the temperature and conveying time for each step for the dry lubricant formation are set in such a manner as to allow the cold plastic working materials 1 to have a temperature between 50 and 60° C., on the assumption that the room temperature surrounding the pressing machine is 40° C. That is, the temperature and conveying time for each step are set to allow the cold plastic working materials 1 to have a temperature higher, or preferably 10° C. higher than the room temperature surrounding the pressing machine.

The water dry type lubricant may be that sold under the tradename FINELUVE™ 750H by Nihon Parkerizing Co., Ltd. However, it is not necessary to limit the water dry type lubricant to this product. Various lubricants can be used.

The description will now be made for the operational steps for the formation of the lubricant dry coat on the surface of the cold plastic working materials 1.

The cold plastic working materials 1 are first conveyed to the heating unit 2 by the conveyor belt 5, and then rotated 90 degrees along the conveying path just before the heating unit 2 to have the tail portions facing the heating unit 2. Thereby, the cold plastic working materials 1 are conveyed into the storage chambers 6 through the throw-in port 16, while maintaining its horizontally held position. After one of the cold plastic working materials 1 is placed in a corresponding storage chambers 6, the rotating drum 7 rotates in the clockwise direction as viewed from the conveyor belt 5 by a predetermined angle, and stops, so that the rotating drum intermittently rotates to successively introduce the storage chambers 6 to the throw-in port 16. In this embodiment, the storage chambers 16 travel along the circular path around the rotation axis of the rotating drum 7. Since the rotating drum rotates synchronously with the conveyor belt 5, the cold plastic working materials 1 fed by the conveyor belt 5 are successively placed into the storage chambers 6.

Figure 5:
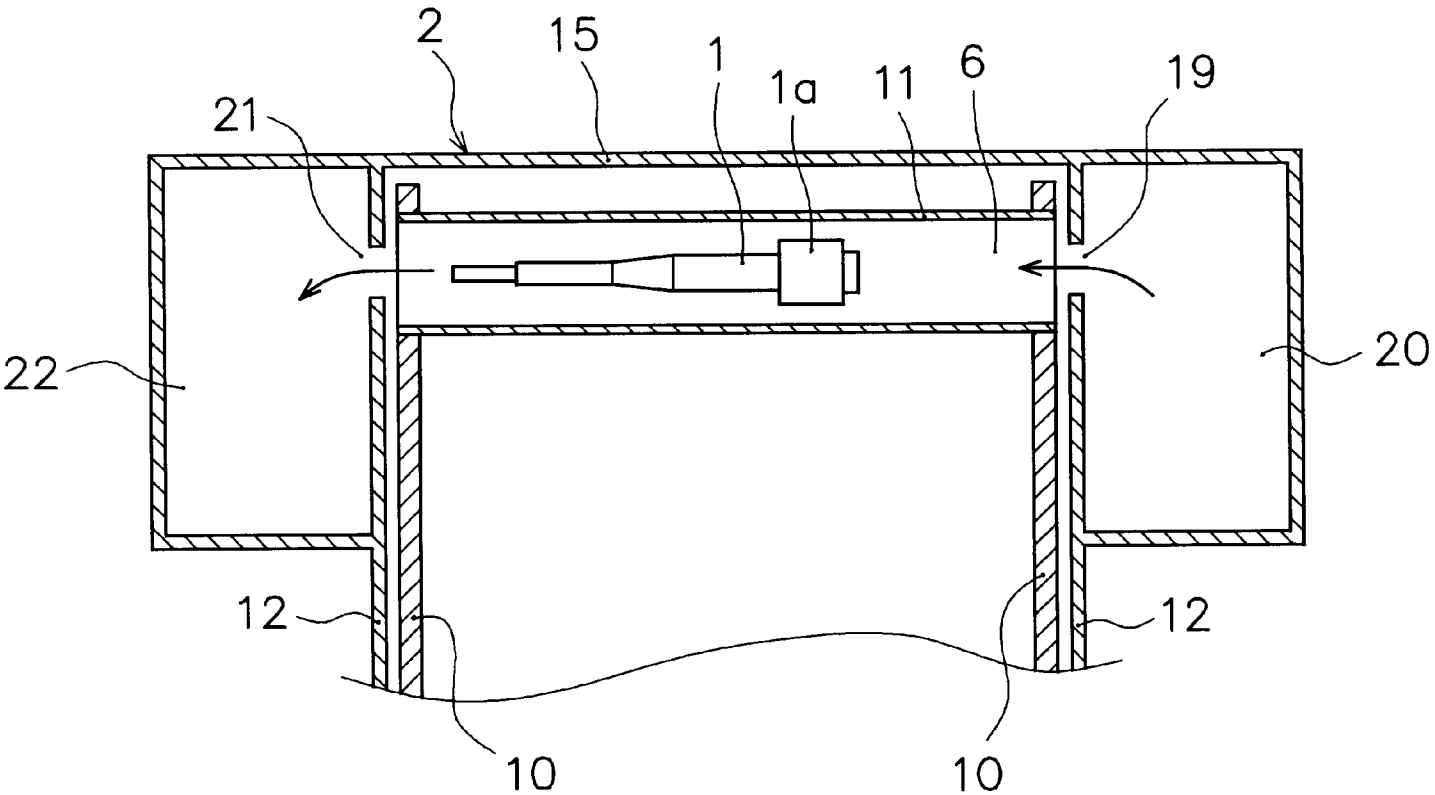
FIG. 5 is a cross section of the essential portion of the heating unit.

When the storage chambers 6 with the cold plastic working materials 1 therein reach the slit 19 through the rotation of the rotating drum 7, the heated air stream introduced through the slit 19 pass through the storage chambers 6, during which the heated air stream can directly be applied to the cold plastic working materials 1, as illustrated in FIG. 5. The application of the heated air stream to each cold plastic working material 1 is continued up to the time when a corresponding storage chamber 6 passes through the slit forming region. During the application of the heated air stream, the cold plastic working materials are heated to a predetermined temperature (e.g., about 60° C.). The heated cold plastic working materials 1 are then successively pushed out of the storage chambers 6 towards the front side of the rotating drum 7 and fed onto the conveyor belt 5 by the pusher 18 when the corresponding storage chambers 6 are drawn to the discharging port 17, where the pusher 18 repeatedly moves into and out of the storage chambers 6 in synchronization with the rotating drum 7. After the cold plastic working materials 1 are unloaded from the storage chambers 6, the empty storage chambers 6 travel back to the throw-in port 16 for receiving new cold plastic working materials 1.

According to the above heating step, the heating unit 2 employs a rotating arrangement, which is advantageous in a limited installing space as compared with a rectilinear arrangement. In addition, the direct application of the heated air stream to the cold plastic working materials 1 is advantageous in the fact that the heating time for heating them to a predetermined temperature can be shortened as compared with the heating operation carried out in a hot ambient environment. As a further advantage, the above arrangement allows the heated air stream to flow straight through the storage chambers 6 in the axial direction of the rotating drum 7, and the cold plastic working materials 1 to be placed in such air stream, so that the heat efficiency is improved. Thus, the cold plastic working materials 1 can securely be heated in a short period of time, unlike a simple application of the heated air stream.

Since the heating unit 2 of this embodiment has an arrangement that the slit 19 continuously extends along the circular path (in the circumferential direction), and the heated air stream supplying duct 20 covers the slit 19 throughout the entire length of the slit 19, the continuous stream of the heated air can be formed in the circumferential direction of the rotating drum 7, unlike the arrangement where the heating is carried out only at a single point on the way to the discharging port 17. The cold plastic working materials 1 thus pass through such a continuous air stream in the orthogonal direction to the stream direction, so that the heated air stream can be applied to the cold plastic working materials 1 both during the rotating and stopping states of the rotating drum 7. This continuous application of the heated air stream can achieve more efficient heating of the cold plastic working materials 1, and limit variation in heated temperature of each cold plastic working material. In addition, the head portions having a larger diameter of the cold plastic working materials, which are hard to be heated, face the slit 19 can be easily heated in the same manner as the tail portions.

The most of the heated air stream introduce through the slit 19 passes through the respective storage chambers 6 and into the heated air stream discharging duct 22, thereby limiting the heat loss. Therefore, the heating operation by the heater 25 can be economically performed, and the temperature control or the control of the heater 25 can easily be achieved. A plurality of small holes can be defined in each hollowed cylindrical member 11. However, it is preferable to form no small holes in order to increase the amount of the heated air stream passing through the storage chambers 6, and hence limit the heat loss.

The cold plastic working materials 1 subjected to the heating process and fed on the conveyor belt 5 are then turned 90 degrees with respect to the conveying path from the horizontal orientation to the vertical orientation, successively conveyed towards the applicator 3, and fed on the holding member (not shown) of the applicator 3. The holding member is lowered to immerse the cold plastic working materials 1 in the lubricant, thereby applying the lubricant on their surfaces. The holding member is then moved upwards to the conveying level of the conveyor belt, and feed the cold plastic working materials 1 on the endless conveyor chain 29. In this lubricant application process, the temperature of the lubricant is equal to the heated cold plastic working materials 1, so that they can be fed to the drying unit 4 without lowering the temperature of the cold plastic working materials 1.

However, it is possible to set the lubricant at ambient temperature or the like. In that case, the heating temperature of the heating unit 2 is preferably set to be slightly higher than that in the above mentioned operation.

The conveyor chain 29 of the drying unit 4 then transfers the cold plastic working materials 1 into the drying chamber 27, in which the stagnant lubricant is blown away from the cold plastic working materials 1 through the application of the pressurized air discharged through the nozzles 33 to the surfaces of the cold plastic working materials 1, thereby obtaining a uniform thickness of the lubricant coat. After that, the cooling air discharged from the air blowing tube 34 is applied to the cold plastic working materials 1 from below to dry the lubricant. When the cold plastic working materials 1 are moved out of the drying chamber 27, the lubricant dry coats are formed on their surfaces. Since the lubricant is dried through the application of the cooling air stream, it is possible to prevent the excessive heating of the cold plastic working materials 1, and simultaneously achieve the shortening of the lubricant drying time. In addition, the exhaustion of the air to the outside of the drying chamber 27 through the exhaust fans 32 reduces moisture in the drying chamber 27.

As described above, the lubricant coat forming apparatus according to this embodiment can shorten the heating time by using the heating unit 2, and also shorten the drying time by using the drying unit 4, with the result that the total time for forming the dry coat can be remarkably shortened. Thus, such a shortened tact time for feeding the cold plastic working materials 1 to the pressing machine can sufficiently cope with a high-speed pressing machine.

The most proper thickness of the dry coat depends on the finished shape of metallic materials, finished surface roughness, and the like. However, the dry coat may have a thickness in the range between 1 to 50 $\mu$m, and more preferably 5 to 40 $\mu$m. When the dry coat is excessively thin, it may burn. Contrarily, an excessively thicker dry coat may cause clogging in the die of the pressing machine, which may in turn cause defect in shape of the resulting products, and/or such a thicker dry coat may have the dry coat which cannot be drawn into the die or onto processing surface, and excluded therefrom, resulting in substantial loss of the water dry lubricant.

The effectiveness in drying the lubricant was evaluated by applying a heated air stream, and a cooling air stream respectively to the cold plastic working materials. The testing results are as follows:

When the cold plastic working material of 50° C. with a lubricant coat thickness of 100 $\mu$m is dried with a heated air stream of 125° C., it took 125 seconds for the cold plastic working material to have a dried lubricant thickness of 30 $\mu$m, or reduce the contained water by 70%. On the contrary, when the cold plastic working material of 63° C. having the same lubricant coat thickness is dried with a cooling air stream of 27° C., the necessary time for obtaining the same dried thickness and dried condition was 48 seconds, which is less than a half of the above time period. The drying by the application of a heated air stream also increased the temperature of the cold plastic working material 1 to 70° C. after the drying (in 125 seconds). On the contrary, the drying by the application of a cooling air stream decreased the temperature of the cold plastic working material 1 to 52° C. In the testing, the thickness of the lubricant dry coat was measured by using a coat thickness measuring instrument, and the thickness of the lubricant wet coat was calculated from the cubic volume of the lubricant and the lubricant applied surface area. In this testing, the lubricant was that sold under the tradename of FINELUVE™ 750H by Nihon Parkerizing Co., Ltd., but the other lubricants also produced the same effect.

Figure 7:
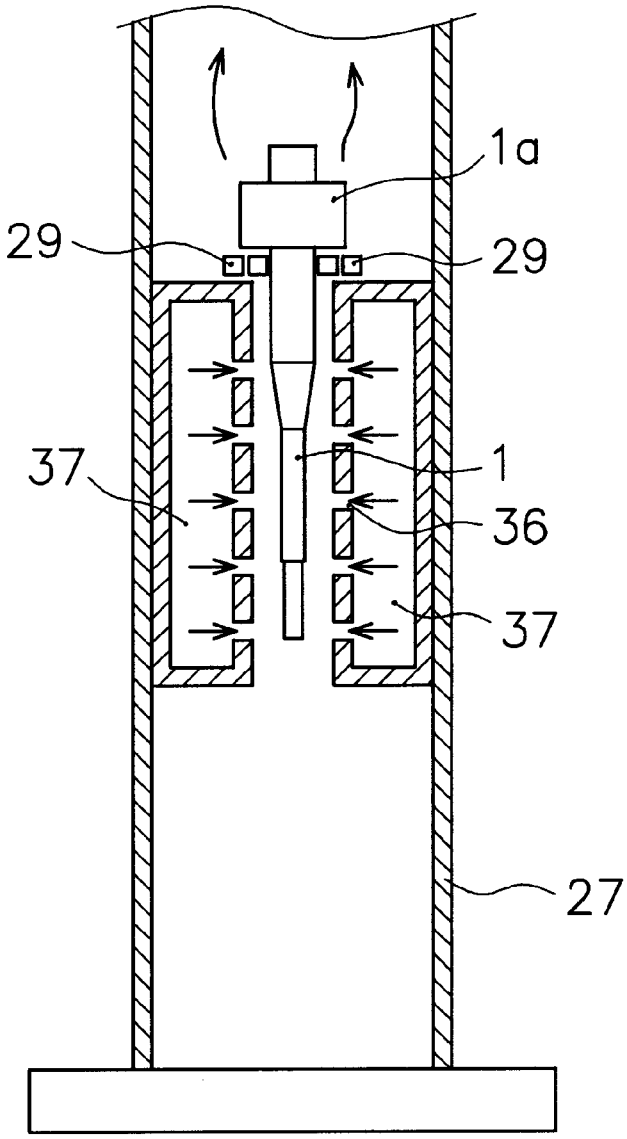
FIG. 7 is a schematic cross section of the drying unit of the lubricant coat forming apparatus according to another embodiment of the present invention.

In the aforesaid description, the drying unit 4 has an arrangement which allows the cooling air to be applied to the cold plastic working materials 1 from below. However, it is possible to employ the arrangement where air feeding tubes 37 are respectively disposed in the lateral side of the conveying path of the cold plastic working materials 1 substantially throughout the length of the drying chamber 27 to discharge the cooling air in the horizontal direction via a number of small holes 36 defined in the laterally inwardly facing sides of the air feeding tubes 37, as illustrated in FIG. 7.

The heating means for heating the cold plastic working materials 1 to a predetermined temperature may take various forms in addition to the heated air application arrangement. For example, the cold plastic working materials 1 may be immersed in a hot bath. In this case, the cold plastic working materials 1 stored in the storage chambers 6 of the rotating drum 7 may be successively immersed in the hot bath as they are rotated by the rotating drum 7. An example of different heat application arrangement will be described hereinbelow. Corresponding or identical parts to those of the first embodiment have been given the same reference characters to omit the detailed description thereof.

Second Embodiment

Figure 8:
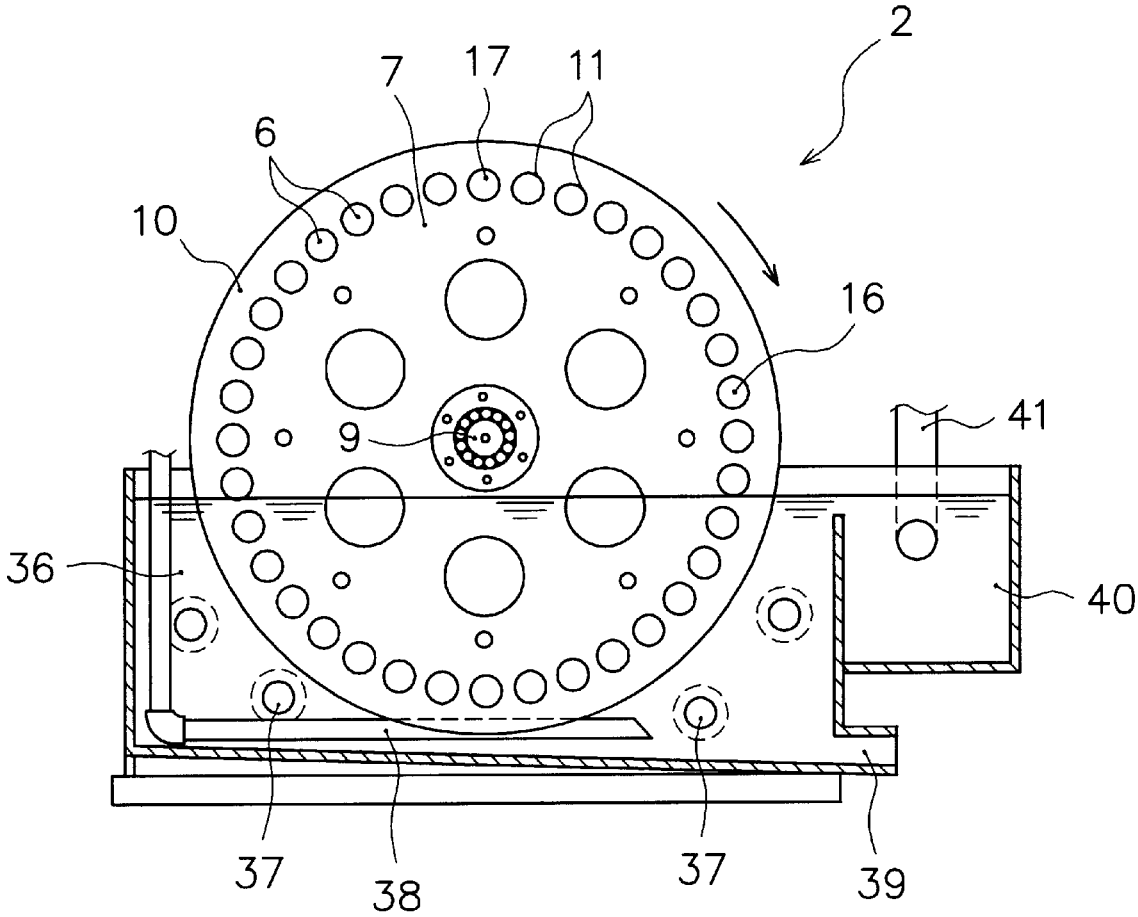
FIG. 8 is a front view of a heating unit of a lubricant coat forming apparatus according to still another embodiment of the present invention.
Figure 9:
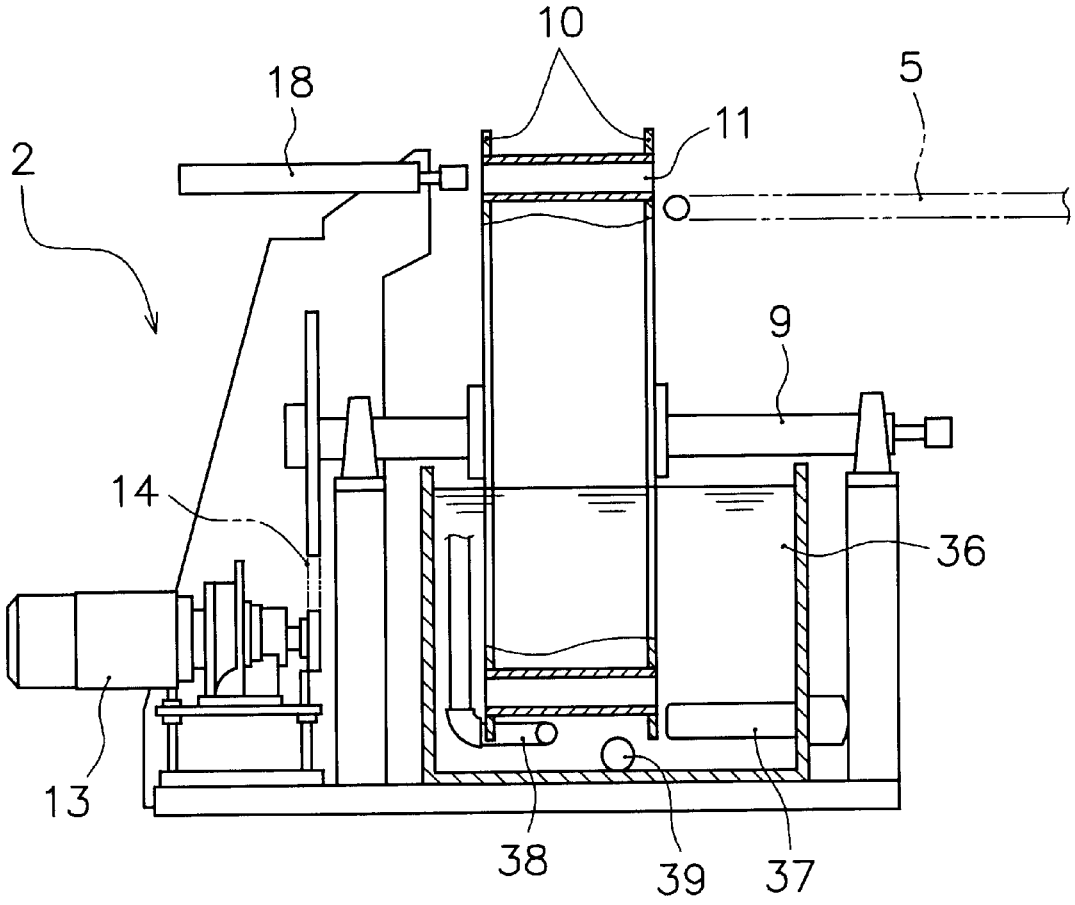
FIG. 9 is a side view of the heating unit of FIG. 8.

As illustrated in FIGS. 8 and 9, the heating unit 2 includes the rotating drum 7 having a cylindrical body with the storage chambers 6 for respectively storing the cold plastic working materials 1 therein, and a hot bath 36 that holds hot water kept at a predetermined temperature and is disposed to allow a part of the rotating drum 7 to be immersed in the hot water. The hot bath 36 is an alternative to the cover member 8 of the first embodiment covering the rotating drum 7 to constitute a substantially sealed heating chamber.

The storage chambers 6 of the rotating drum 7 each extend parallel to the axis of the rotating drum 7 and are open to the outside of the rotating drum 7 through both end surfaces of the rotating drum 7. The storage chambers 6 are disposed around the circumferential periphery of the rotating drum 7 at intervals. In this embodiment, thirty six storage chambers are disposed at a constant pitch of substantially ten degrees on the same circle.

The rotating drum 7 includes the substantially horizontally extending rotating shaft 9 adapted to be driven by the motor 13, the two circular plates 10 respectively fixed to the front and rear sides of the rotating shaft 9, and the plurality of hollowed cylindrical members 11 extending between both circular plates 10. The circular plates 10 each define rounded holes around the circumferential periphery at intervals to securely receive the cylindrical members 11, thereby respectively forming the storage chambers 6 within the cylindrical members 11. The rotating shaft 9 extends through the circular plates 10 to be supported thereon, in which one end of the rotating shaft 9 projects away from the cover member 8 and is operatively connected to the motor 13 via the driving chain 14, thereby transmitting a driving force of the motor to the rotating shaft 9. The motor 13 is controlled to intermittently rotate with an intermittent pitch matching with the pitch of the storage chambers 6.

The hot bath 36 is disposed to accommodate substantially a lower half of the rotating drum 7, and holds hot water of such an amount as not to immerse the rotating shaft 9 therein. Specifically, in this embodiment, the hot water is held within the hot bath to immerse fifteen cylindrical members 11 therein. The hot water is kept at a temperature between 60 and 70° C. by sheath heaters 37 as heating means disposed at proper positions in the hot bath 36.

A pipe 38 extends into the hot bath 36 to feed hot or cold water from the outside. The hot bath 36 has a bottom surface slightly tilting to have a lower side with a drain pipe 39 connected thereto. An auxiliary bath 40 is connected to a part of the hot bath 36 to collect the hot water from the hot bath 36 and purify the collected hot water via a discharging pipe 41 connected to the auxiliary bath 40.

Since the heating unit 2 of this embodiment is not provided with the cover member 8 unlikely to the first embodiment, the cold plastic working materials 1 are directly placed into the cylindrical members 11, and then directly discharged onto the conveyor belt 5 after subjected to the hot bath treatment. Therefore, the material throw-in port 16 is located so as to correspond in position to a cylindrical member 11 located just before the point at which the cylindrical members 11 are immersed in the hot water, or a cylindrical member 11 located at the third position from the surface of the hot water in the reverse direction of the rotating drum 7, while the material discharging port 17 is located so as to correspond in position to a cylindrical member 11 which has been moved out of the hot water, or a cylindrical member 11 located at the uppermost position of the rotating drum 7. When two lines of the conveyor belt 5 are arranged, a cylindrical member 11 at a different position is preferably selected to form an additional throw-in port 16 or discharging port 17 for an additional line of the conveyor belt 5.

Disposed rearwards to one of the circular plates 10 is the pusher movable into and away from the storage chambers 6 through the rounded hole to push the cold plastic working materials 1 out of the storage chambers 6 through the discharging port 17, thereby feeding them onto the conveyor belt 5 located forwards to the rotating drum 7.

According to the thus arranged heating unit 2, the cold plastic working materials 1 thrown into the storage chambers 6 through the throw-in port 16 are intermittently rotated at a predetermined pitch (about 2 sec./pitch), so that they are immersed within the hot bath 36 for a predetermined period of time (about 2 sec.×16 pitches=about 32 sec.). During the immersing, the cold plastic working materials 1 are heated to a temperature slightly lower than the hot water. For example, the cold plastic working materials 1 are heated to a temperature between 55 and 65° C., when the hot water has a temperature between 60 and 70° C. It will be understood that there are not any substantial differences in arrangement for throw-in and discharging of the cold plastic working materials 1 between the first and second embodiments.

The above heating arrangement produces desirable effects. Specifically, the heating unit 2 of a rotational type contributes to a smaller sized hot bath 36, and a smaller sized installing space. The smaller sized hot bath 36 desirably has a reduced amount of the hot water. The heating arrangement with the hot bath also produces an effect of washing away dusts or any undesirable matters from the cold plastic working materials 1, and hence forming a dry coat of a more uniform thickness.

The hot water held within the hot bath 36 is set to have a temperature around a temperature desirable for the cold plastic working materials subjected to the heating treatment, so that, even if the time period required for the hot bath immersing treatment, or the time period required for the cold plastic working materials 1 to be immersed in the hot water is varied within a certain range, the cold plastic materials 1 after the hot bath immersing treatment are unlikely to have a temperature greatly varied. Accordingly, the heating arrangement of this embodiment is advantageous in the fact that the temperature control of the cold plastic working materials 1 in the heat treatment can easily be accomplished.

Although the hot water of 60 to 70° C. hardly causes an undesirable effect, a cover member is preferably placed on the hot bath 36 of the heating unit 2 to avoid the diffusion of the evaporated water from the hot bath 36. Although the cylindrical members 11 having the open ends, through which the hot water is introduced into the storage chambers 6, may not pose a problem, a plurality of small holes are preferably formed in each cylindrical member 11 to accomplish a smooth communication of the hot water between the inside and outside of each storage chamber 6 by means of punching treatment or the like. Moreover, the heating unit 2 may have the rotating shaft 9 immersed in the hot water, as long as the liquid tightness for the rotating shaft 9 of the rotating drum 7 can be assured.

As is apparent from the above description, the heating arrangement with the hot bath is also advantageous in the fact that the heating time for heating the cold plastic working materials to a predetermined temperature can be shortened as compared with the heating operation carried out in a hot ambient environment, resulting in a shortened period of time for forming lubricant dry coat.

This specification is by no means intended to restrict the present invention to the preferred embodiments set forth therein. Various modifications to the lubricant coat forming apparatus, as described herein, may be made by those skilled in the art without departing from the spirit and scope of the present invention as defined in the appended claims.

What is claimed is:

1. A lubricant coat forming apparatus for forming a dry coat of water dry lubricant on the surface of each cold plastic working materials, which comprises:

a heating unit for heating the cold plastic working materials to a predetermined temperature;

a lubricant applicator for applying the lubricant on the surfaces of the plastic working materials heated by said heating unit;

a drying unit for drying the lubricant applied on the surfaces of the plastic working materials; and said heating unit including a plurality of storage chambers disposed at intervals for respectively storing the plastic working materials therein, a throw-in port through which the plastic materials are respectively thrown into said plurality of storage chamber, and a discharging port through which the plastic working materials are discharged from said plurality of storage chambers, said plurality of storage chambers adapted to travel along a circular path starting from said throw-in port and returning thereto via said discharging port, and said heating unit further including a means for immersing the plastic working mateials in the plurality of storage chambers in hot water, thereby heating the plastic working materials to a predetermined temperature.

2. A lubricant coat forming apparatus according to claim 1, wherein said drying unit is adapted to apply cooling air stream to the plastic working materials to the dry the lubricant applied on the surfaces of the plastic working materials, said cooling air stream having a temperature lower than that of the plastic working materials heated by said heating unit.

* * * * *

UNITED STATES PATENT AND TRADEMARK OFFICE

CERTIFICATE OF CORRECTION

PATENT NO. : 6,514,340 B1 
DATED : February 4, 2003
INVENTOR(S) : Kimio Momose et al.

It is certified that error appears in the above-identified patent and that said Letters Patent is hereby corrected as shown below:

Title page,
Item [73], Assignee, please replace "Honda Motor Co., Ltd., Tokyo (JP)" with -- Honda Giken Kogyo Kabushiki Kaisha, Tokyo (JP) --.

Signed and Sealed this

Twenty-sixth Day of August, 2003

JAMES E. ROGAN
*Director of the United States Patent and Trademark Office*